US011313111B1

(12) United States Patent
Chen et al.

(10) Patent No.: US 11,313,111 B1
(45) Date of Patent: Apr. 26, 2022

(54) FAUCET THAT CAN BE EQUIPPED WITH AN AIR GAP DEVICE

(71) Applicants: Jui-Chien Chen, Lugang Township, Changhua County (TW); Jui-Ching Chen, Lugang Township, Changhua County (TW)

(72) Inventors: Jui-Chien Chen, Lugang Township, Changhua County (TW); Jui-Ching Chen, Lugang Township, Changhua County (TW)

( * ) Notice: Subject to any disclaimer, the term of this patent is extended or adjusted under 35 U.S.C. 154(b) by 0 days.

(21) Appl. No.: 16/951,670

(22) Filed: Nov. 18, 2020

(51) Int. Cl.
*E03C 1/10* (2006.01)
*E03C 1/04* (2006.01)

(52) U.S. Cl.
CPC ..... *E03C 1/102* (2013.01); *E03C 1/04* (2013.01)

(58) Field of Classification Search
CPC ..... E03C 1/102; E03C 1/04; Y10T 137/3258
See application file for complete search history.

(56) References Cited

U.S. PATENT DOCUMENTS 3,967,638 A * 7/1976 Tondreau ..... B01D 61/10 137/216
4,134,419 A * 1/1979 Richetti ..... F16K 24/06 137/216
4,454,891 A * 6/1984 Dreibelbis ..... B01D 61/10 137/216
4,856,121 A * 8/1989 Traylor ..... E03C 1/0401 4/678
4,967,784 A * 11/1990 Barhydt, Sr ..... E03C 1/0401 137/216
5,127,427 A * 7/1992 Kajpust ..... E03B 7/072 137/216
5,176,165 A * 1/1993 Traylor ..... E03C 1/104 137/216.1
5,305,778 A * 4/1994 Traylor ..... E03C 1/102 137/216
5,388,287 A 2/1995 Tischler et al.
7,011,106 B2 3/2006 Kawolics et al.
7,353,838 B2 * 4/2008 Schmitt ..... B01D 61/10 137/216
7,357,147 B2 4/2008 Kawolics et al.
7,743,788 B2 * 6/2010 Schmitt ..... C02F 9/005 137/554
8,733,386 B2 * 5/2014 Sun ..... E03C 1/102 137/216
9,359,749 B1 * 6/2016 Mellits ..... E03C 1/04
2009/0151793 A1 6/2009 Michaels et al.

FOREIGN PATENT DOCUMENTS

TW M424419 U1 3/2012

* cited by examiner

*Primary Examiner* — Kevin R Barss
(74) *Attorney, Agent, or Firm* — Egbert, McDaniel & Swartz, PLLC

(57) ABSTRACT

A faucet that can be equipped with an air gap device, which includes a base, a main body and a control valve, wherein a chamber is formed inside the base, and an air gap device is arranged in the chamber accordingly. The main body is set on the top edge of the base, and the control valve is set inside the main body; a gap is formed between the base and the main body, the gap communicates with the chamber, and the air enters or leaves the chamber through the gap. The overall appearance of the faucet has no visually attractive vents, so the integrity of the appearance can be maintained.

18 Claims, 15 Drawing Sheets

FAUCET THAT CAN BE EQUIPPED WITH AN AIR GAP DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a component of drinking water equipment, and more particularly to the innovative structure type of a faucet that can be equipped with an air gap device.

2. Description of Related Art Including Information Disclosed Under 37 CFR 1.97 and 37 CFR 1.98

Reverse osmosis water treatment equipment will produce wastewater in the course of water treatment. The wastewater is discharged through the drain line. An air gap device is arranged in the upstream water pipe of wastewater drain line, so as to prevent the wastewater from entering water system through the drain line due to siphonage.

U.S. Pat. No. 7,011,106B2 and U.S. Pat. No. 7,357,147B2 patent documents disclose a faucet with an air gap device, including a main body, a valve and an air gap device, wherein the main body defines an inlet and an outlet, a valve chamber is located between the inlet and the outlet, an air gap chamber forms an opening at the first end of the main body, wherein a vent enters the air gap chamber through the wall of the main body. The valve is located in the valve chamber for controlling the liquid to flow from the inlet to the outlet. The air gap device comprises a holder and an air gap structure, the holder and the air gap structure are located in the air gap chamber.

The vent penetrates the wall on one side of the main body. Before the air gap chamber is equipped with the air gap device, a movable cover is installed on the main body to block the vent, no matter whether the main body is provided with the cover, the vent or the cover destroys the appearance integrity of the faucet.

BRIEF SUMMARY OF THE INVENTION

The main purpose of the present invention is to provide a faucet that can be equipped with an air gap device.

Based on the aforementioned purpose, the faucet that can be equipped with an air gap device of the present invention which comprises a base, a chamber is formed inside the base, and an air gap device is disposed in the chamber, the chamber extends to the bottom of the base.

A main body is disposed on the top edge of the base, and a valve chamber, a first channel and a second channel are formed inside the main body. The first channel communicates with the valve chamber and the chamber, the second channel communicates with the valve chamber and the outside of the main body, so that an inlet pipe communicates with the first channel. An outlet pipe communicates with the second channel, and the water enters the valve chamber through the inlet pipe and flows out through the outlet pipe.

A control valve is disposed in the valve chamber, so as to control the water to flow from the first channel to the second channel.

A support block is located between the base and the main body, so that a gap is formed between the base and the main body. The gap communicates with the chamber through at least one connecting passage, and the gap communicates with the space outside the faucet, so that the air enters or leaves the chamber through the gap.

The main effect and advantages of the present invention are that the gap is formed between the base and the main body, the air can enter or leave the chamber through the gap, the overall appearance of the faucet is free of visually attractive vents, and the integrity of the appearance can be maintained.

DETAILED DESCRIPTION OF THE INVENTION

Figure 1:
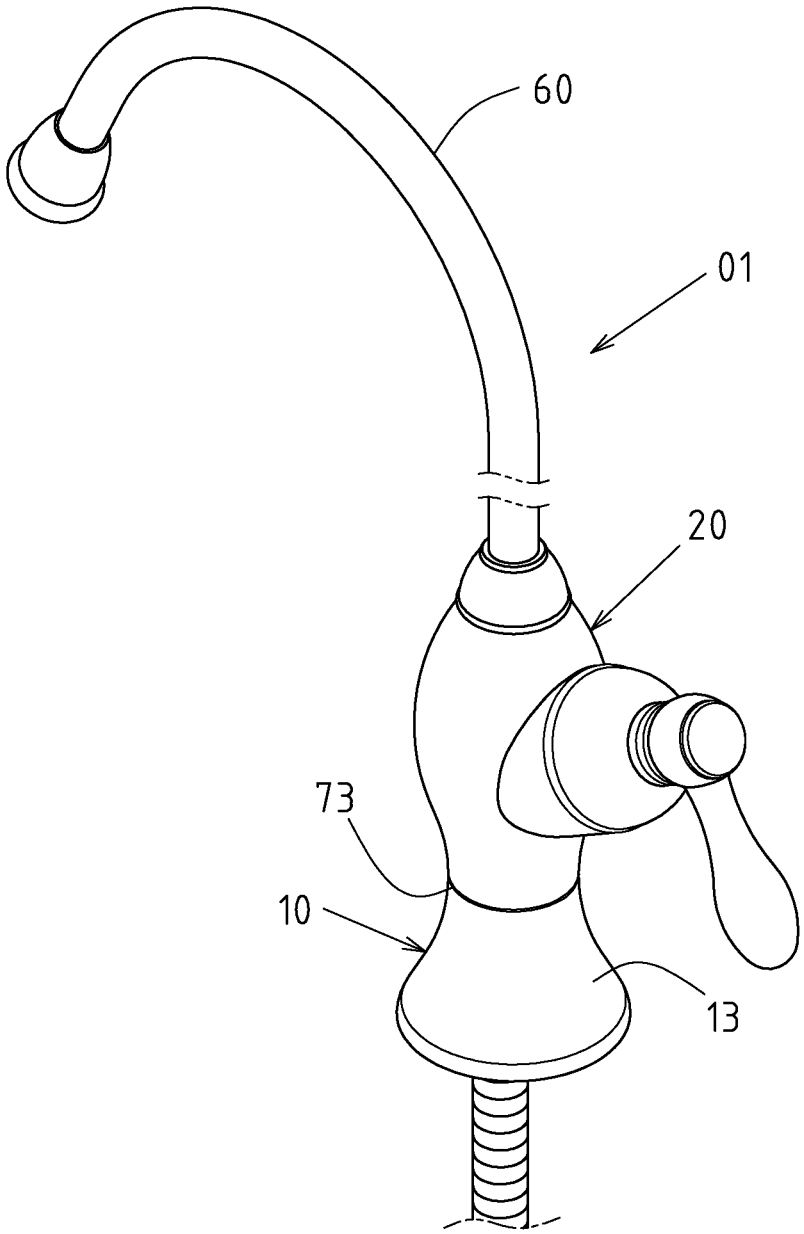
FIG. 1 is the stereogram of the Embodiment 1 of the present invention.
Figure 2:
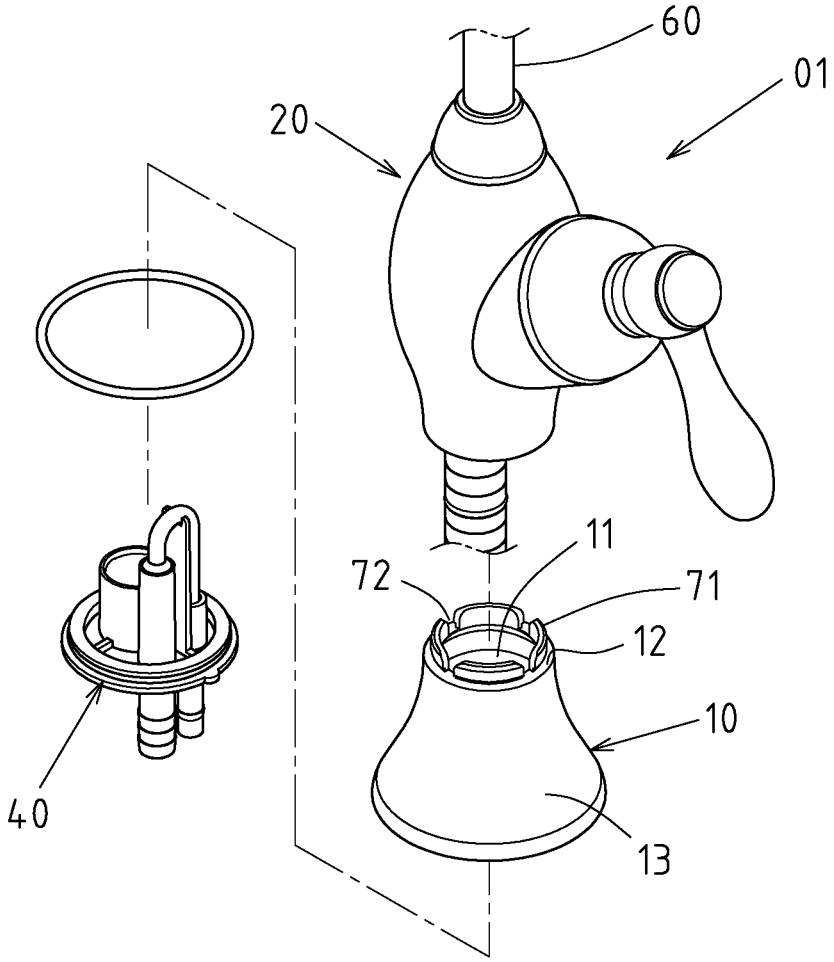
FIG. 2 is the three-dimensional exploded view of Embodiment 1 of the present invention provided with an air gap device.

As shown in FIG. 1 to FIG. 6, the Embodiment 1 of the aforementioned faucet that can be equipped with an air gap device comprises a base 10, a main body 20, a control valve 30 and several support blocks 71, wherein a chamber 11 is formed inside the base 10, and an air gap device 40 is arranged in the chamber 11. The chamber 11 extends to the bottom of the base 10, and the main body 20 is disposed on the top edge of the base 10. A valve chamber 21, a first channel 22 and a second channel 23 are formed inside the main body 20. The first channel 22 communicates with the valve chamber 21 and the chamber 11, the second channel 23 communicates with the valve chamber 21 and the outside of the main body 20, so that an inlet pipe 50 communicates with the first channel 22, and an outlet pipe 60 communicates with the second channel 23, the water enters the valve chamber 21 through the inlet pipe 50 and flows out through the outlet pipe 60. The control valve 30 is disposed in the valve chamber 21, so as to control the water to flow from the first channel 22 to the second channel 23. The control valve 30 is the existing technology the persons of related domains are familiar with, and the specific construction of the control valve 30 will not be described in detail.

The support blocks 71 are located between the base 10 and the main body 20, so that the base 10 and the main body 20 are vertically separated, and a gap 73 is formed between the base 10 and the main body 20. The gap 73 communicates with the space outside the faucet 01. Furthermore, the support blocks 71 are arranged on the top of the base 10, and several connecting passages 72 are formed between the support blocks 71, respectively. The connecting passages 72 communicate with the chamber 11 and the gap 73, respectively. A first surface 24 is formed at the bottom of the main body 20. A slot 25 is formed in the main body 20. The slot 25 extends upwards from the first surface 24 into the main body 20, and the slot 25 communicates with the chamber 11. An abutting surface 26 is formed at one end of the slot 25 far from the first surface 24 of the main body 20. The support blocks 71 enter the slot 25 respectively and prop the abutting surface 26, so that the support blocks 71 support the main body 20. A side slot wall 27 is formed around the slot 25 of the main body 20. The support blocks 71 are laterally opposite to the side slot wall 27 respectively.

The distance in height between the bottom and top of the support block 71 is defined as the first height H1. The distance in height between the first surface 24 and the abutting surface 26 is defined as the second height H2. The first height H1 is larger than the second height H2, so that the gap 73 is formed between the first surface 24 and the top end of the base 10. The gap 73 communicates with the chamber 11 through the connecting passage 72, so that the air enters or leaves the chamber 11 through the connecting passage 72 and the gap 73. The preferred difference between the first height H1 and the second height H2 is 0.05 mm-2 mm. The difference between the first height H1 and the second height H2 can be changed as required. In this case, the difference between the first height H1 and the second height H2 is 0.2 mm.

Figure 3:
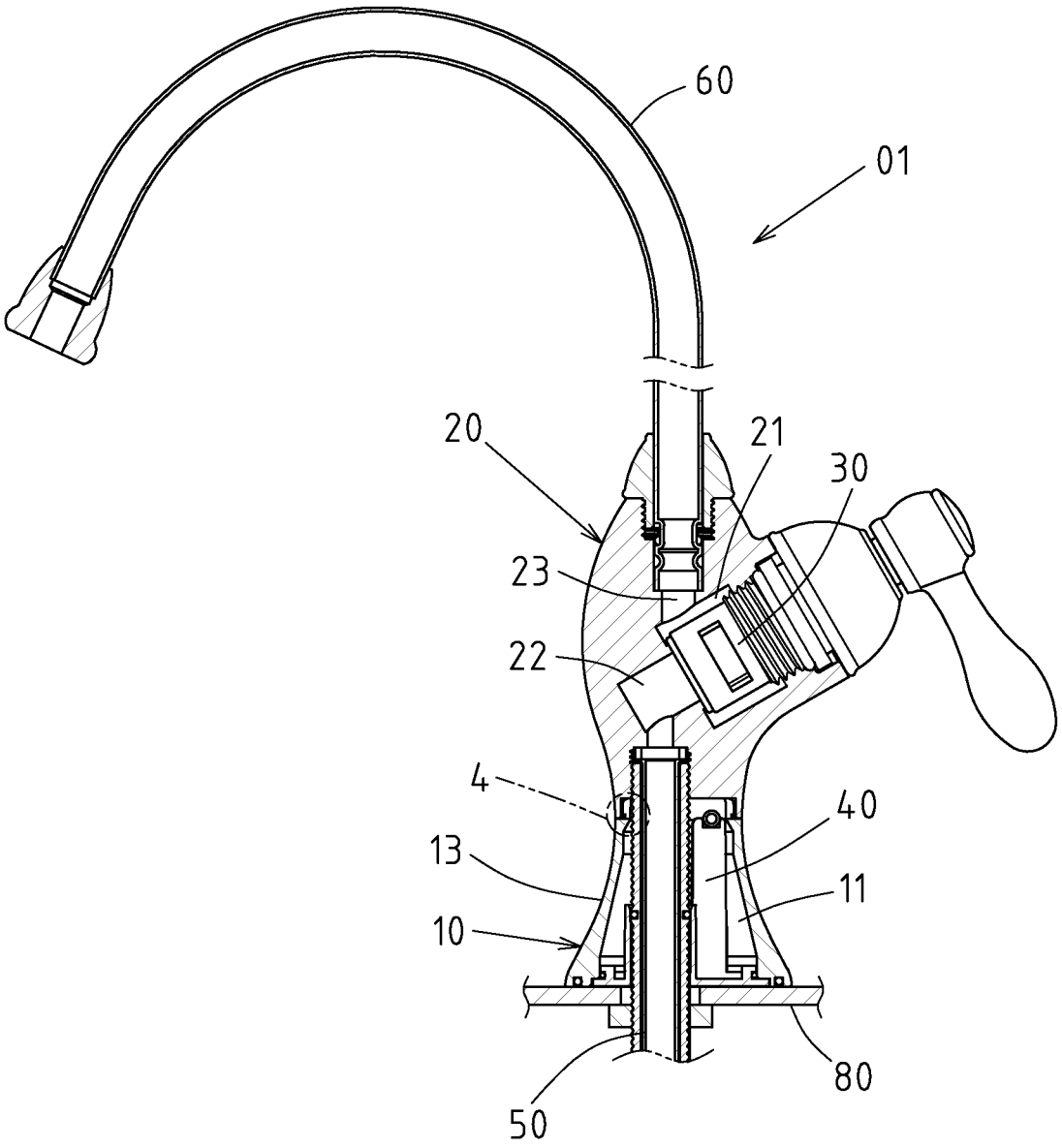
FIG. 3 is the section view of Embodiment 1 of the present invention, presenting the operating state with an air gap device.
Figure 4:
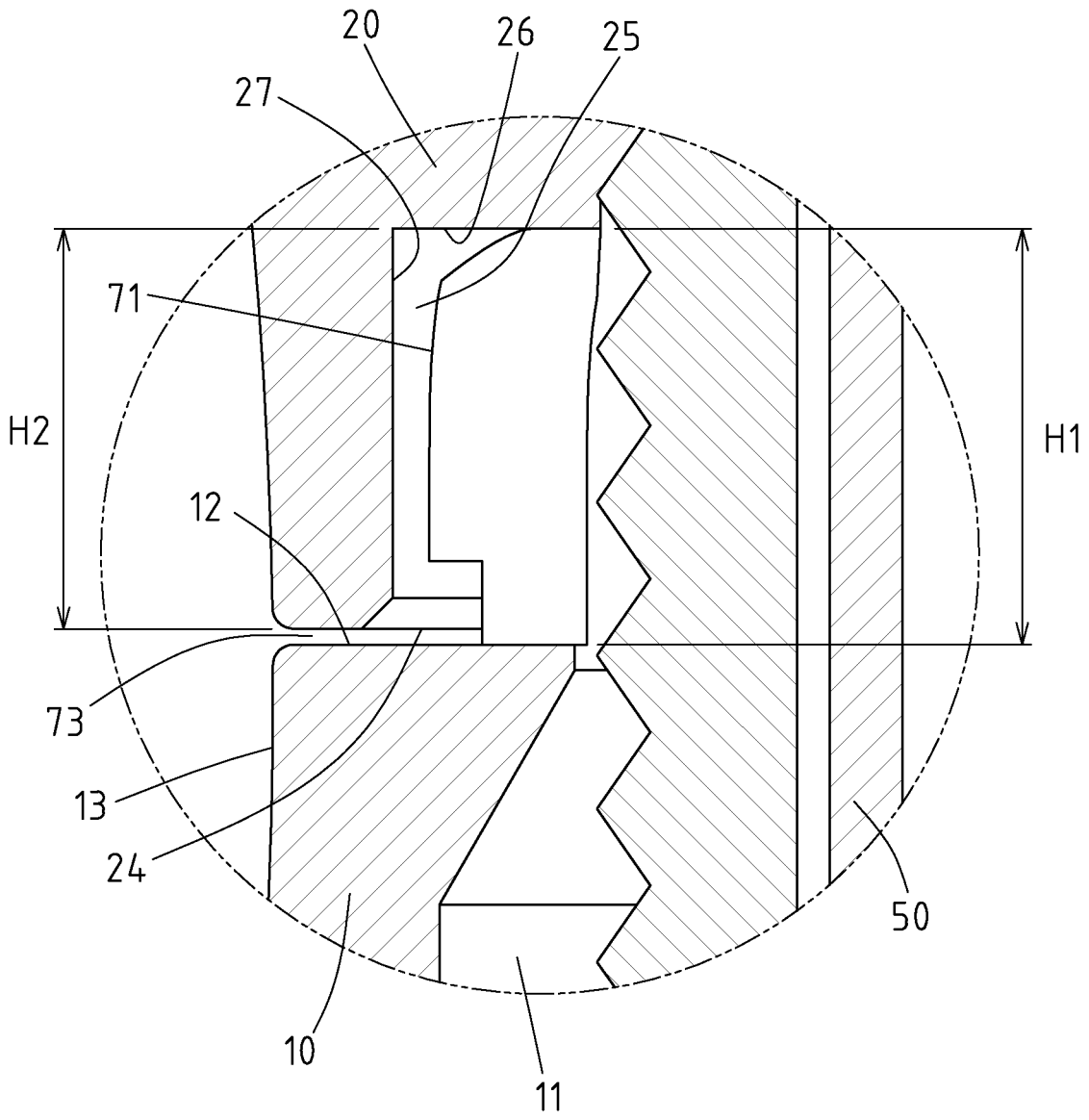
FIG. 4 is the drawing of partial enlargement of FIG. 3, displaying the abutting part of base and main body.
Figure 5:
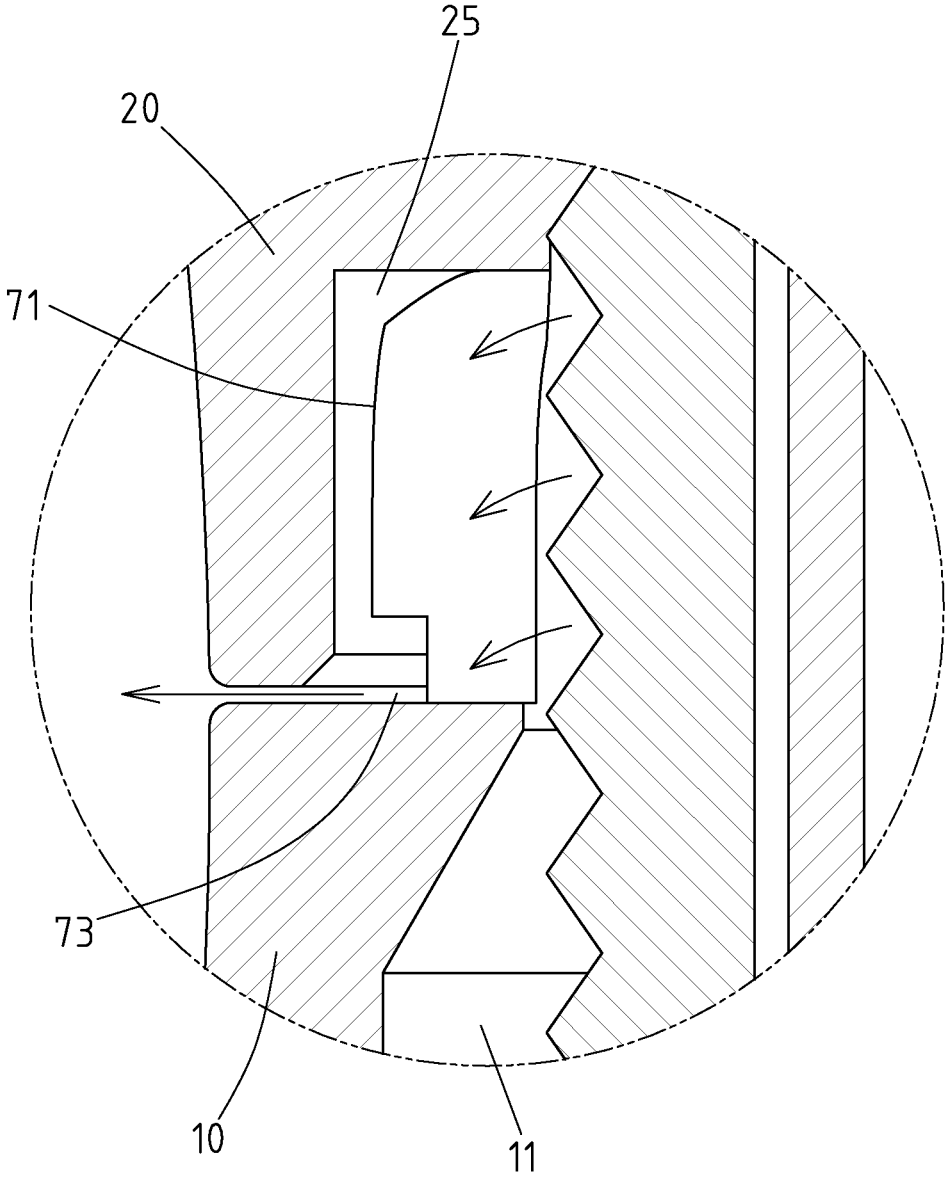
FIG. 5 is the schematic diagram of air flow state of the construction in FIG. 4.

As shown in FIG. 3 to FIG. 5, Embodiment 1 can be configured on a work table 80, and the air gap device 40 is disposed in the chamber 11, the air can leave the chamber 11 through the connecting passage 72 and the gap 73 and flow to the base 10 and the outside of the main body 20 (in the direction of arrow in FIG. 5), the outside air can flow into the chamber 11 through the gap 73 and the connecting passage 72. The gap 73 is a space in a certain width in side direction. The size in height of the gap 73 is microminiaturized, and the air flow will not be influenced. The overall appearance of Embodiment 1 is free of visually attractive vents, and the integrity of the appearance can be maintained.

Figure 6:
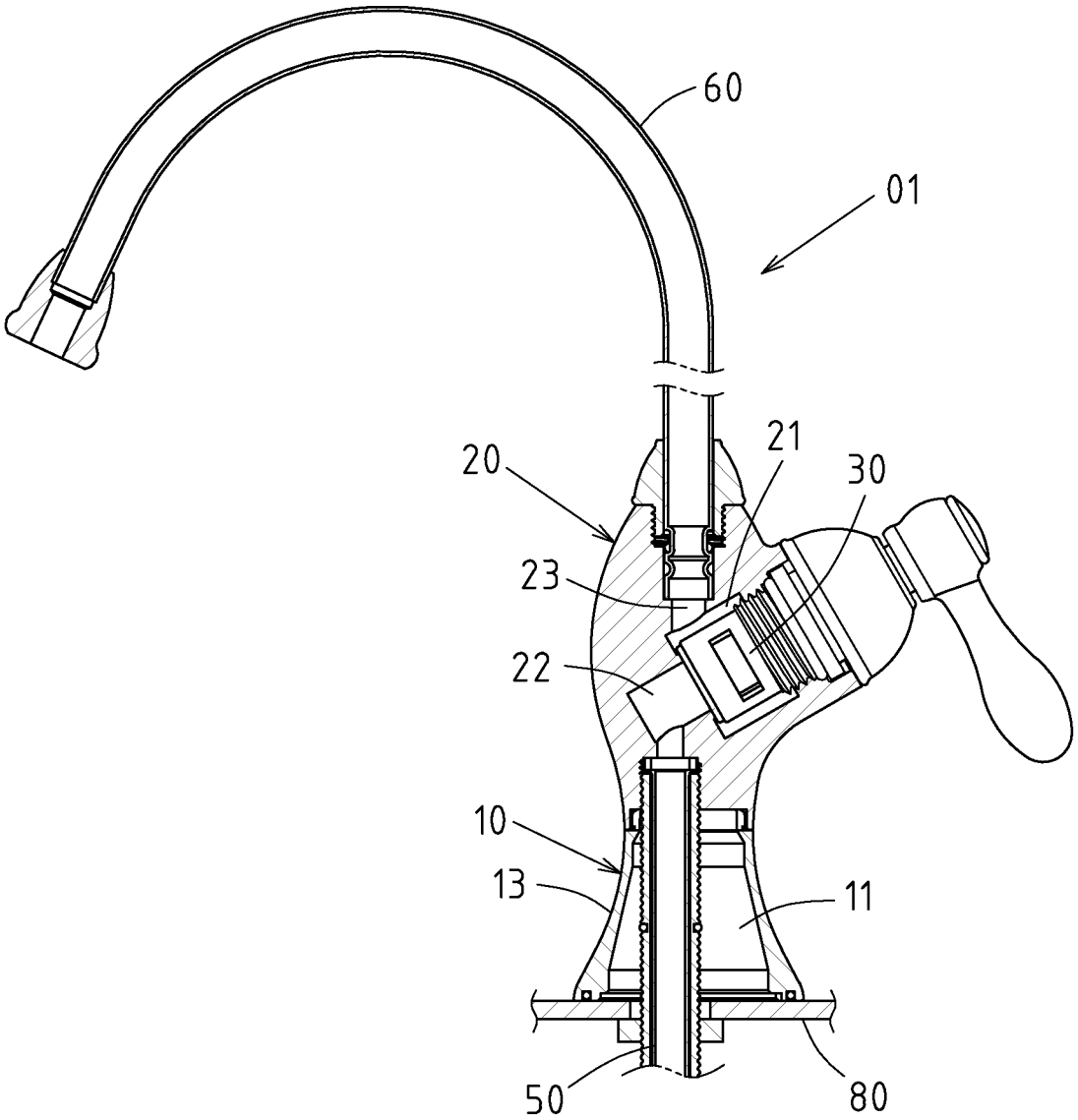
FIG. 6 is the section view of Embodiment 1 of the present invention, presenting the operating state without an air gap device.

As shown in FIG. 6, before the Embodiment 1 is equipped with the air gap device 40, as the size in height of the gap 73 is very small, it is unnecessary to cover or block the gap 73 with additional objects.

The support blocks 71 are annularly arranged on the base 10. The connecting passages 72 are formed between adjacent support blocks 71 respectively. The abutting surface 26 and the side slot wall 27 coordinate with each other to form a ring, fitting the annularly arranged support blocks 71, the gap 73 is annular. Therefore, the gap 73 is annular, in terms of Embodiment 1, the gap 73 exactly forms a visual effect of annular abutting boundary between the base 10 and the main body 20.

The top end of the base 10 has an annular second surface 12, the second surface 12 abuts on the bottom of the support block 71 and the lateral surface 13 of the base 10, the second surface 12 is opposite to the first surface 24, the gap 73 is formed between the first surface 24 and the second surface 12.

Figure 7:
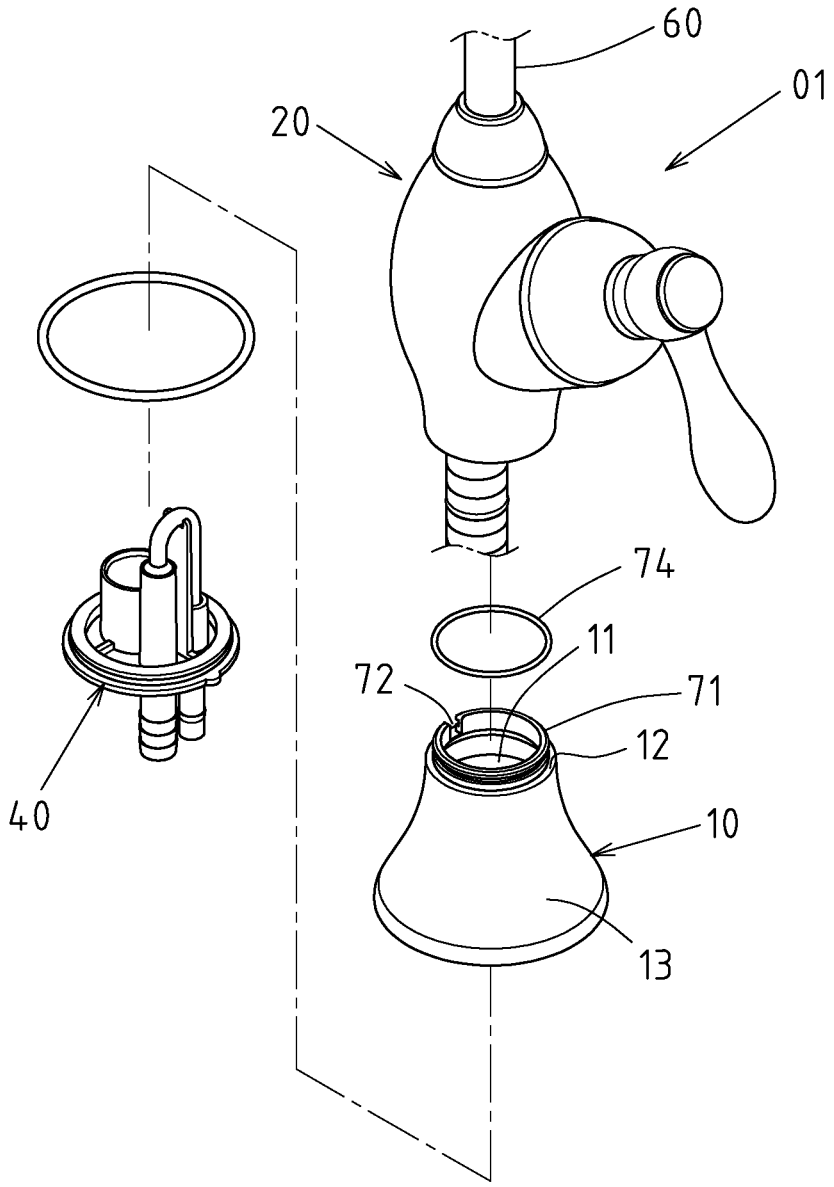
FIG. 7 is the three-dimensional exploded view of Embodiment 2 of the present invention provided with an air gap device.
Figure 8:
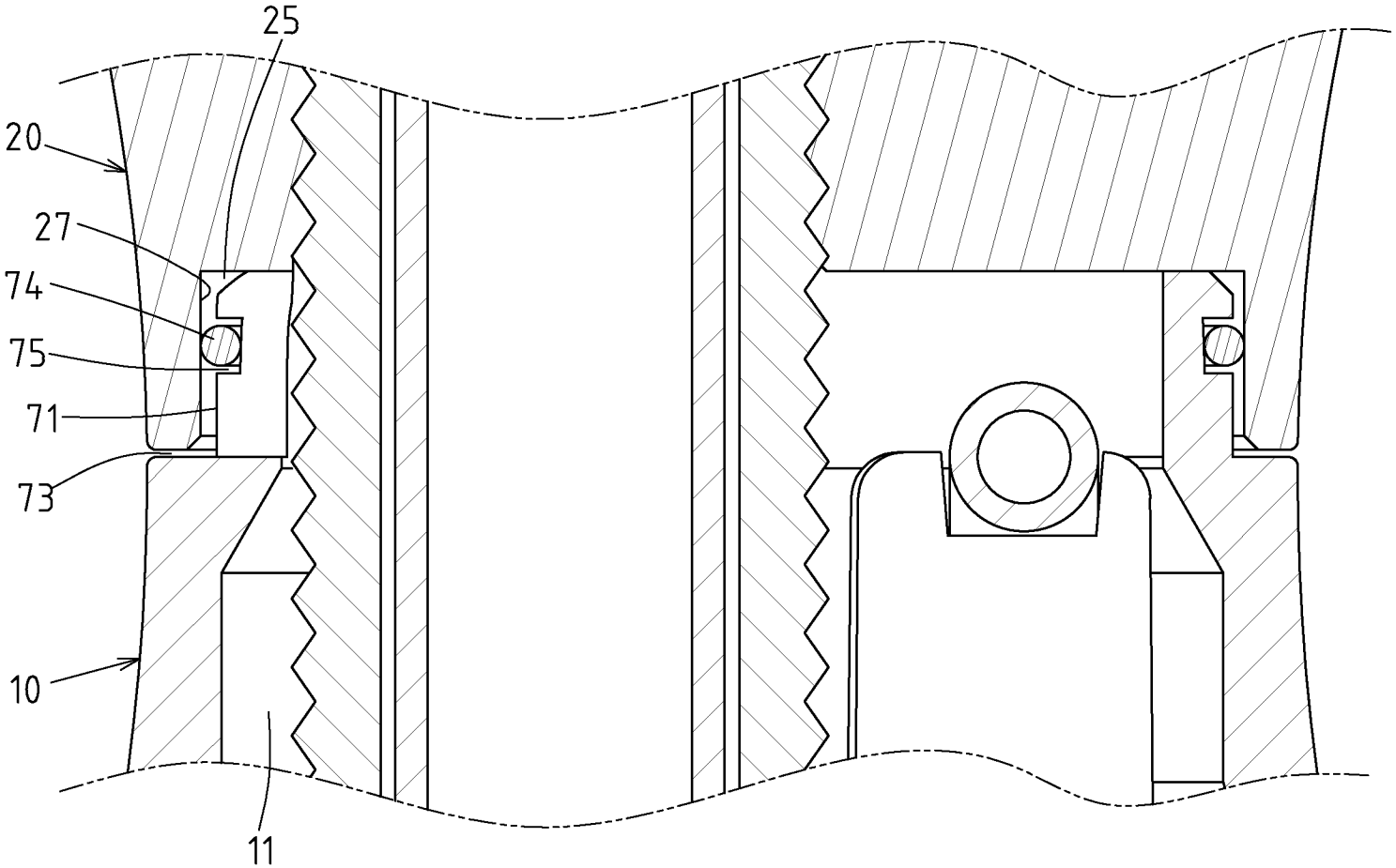
FIG. 8 is the sectional view of partial enlargement of Embodiment 2 of the present invention, displaying the abutting part of base and main body.

As shown in FIGS. 7 and 8, the major difference between Embodiment 2 and Embodiment 1 is that one support block 71 is arranged on the top of the base 10, and the support block 71 is approximately cambered, a connecting passage 72 is formed between the two cambered ends of the support block 71, a ring unit 74 bushes the support block 71. The ring unit 74 is made of elastic material. The ring unit 74 props the side slot wall 27, so as to enhance the reliability of lateral positioning of the main body 20. An embedding groove 75 is made in the side of the support block 71 facing the side slot wall 27. The ring unit 74 is embedded in the embedding groove 75, so as to position the ring unit 74.

Figure 9:
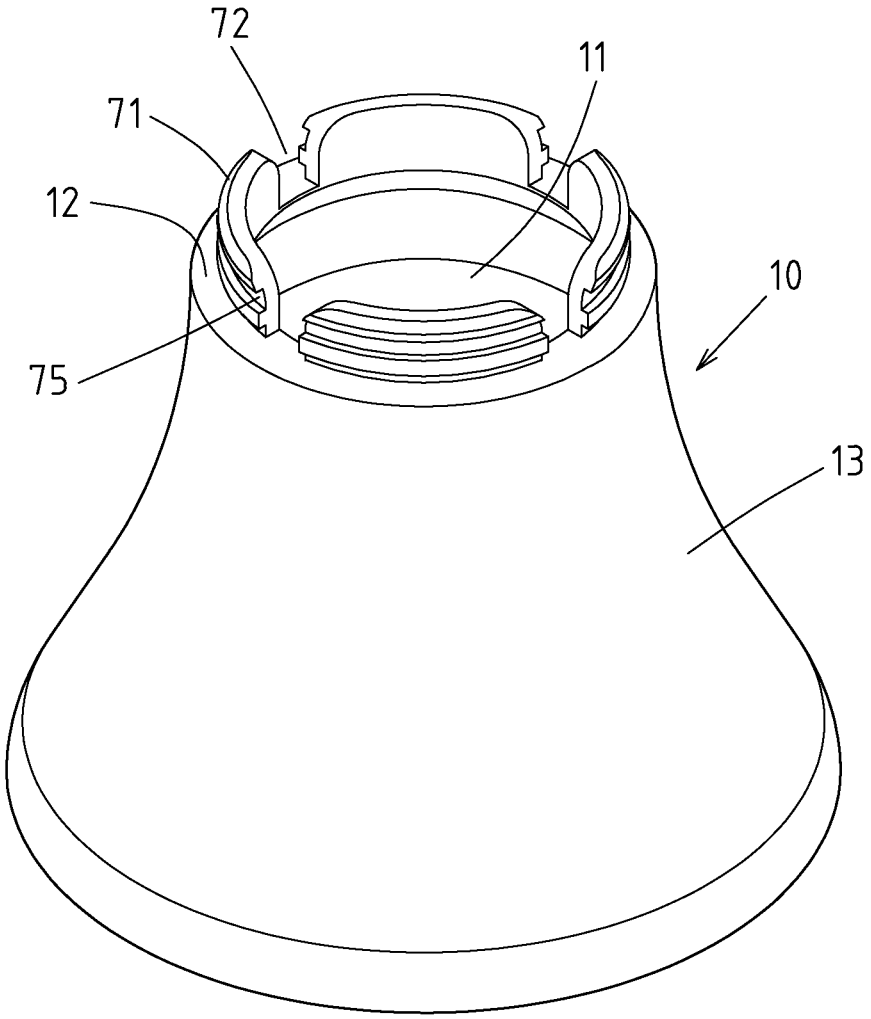
FIG. 9 is the stereogram of base of Embodiment 3 of the present invention.
Figure 10:
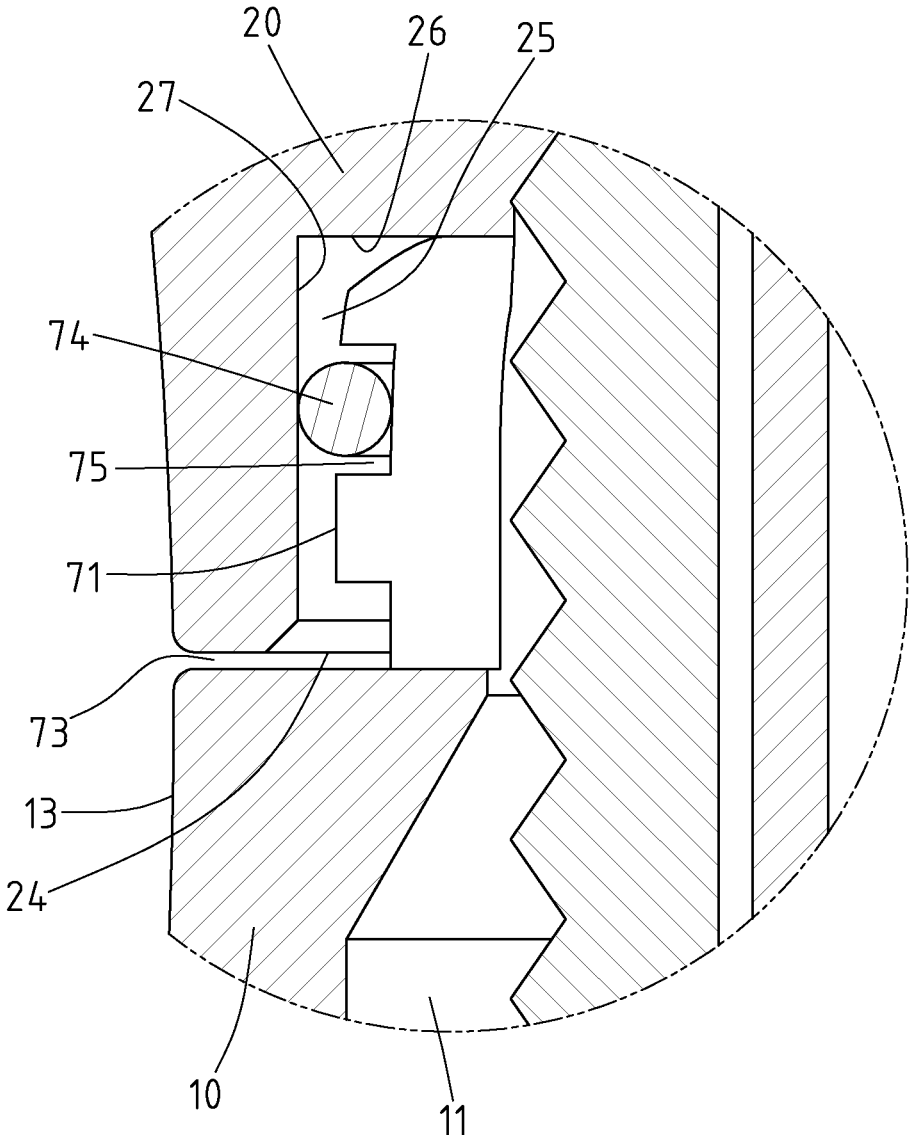
FIG. 10 is the sectional view of partial enlargement of Embodiment 3 of the present invention, displaying the abutting part of base and main body.

As shown in FIGS. 9 and 10, the major difference between Embodiment 3 and Embodiment 1 is that a ring unit 74 bushes the support block 71, the ring unit 74 is made of elastic material, the annular periphery of the ring unit 74 props the side slot wall 27, so as to enhance the reliability of lateral positioning of the main body 20.

Several distances can be formed in radial direction of the main body 20 between the support block 71 and the side slot wall 27. When the main body 20 is disposed on the base 10, the elastic ring unit 74 forms adjacency relations of the support block 71, the ring unit 74 and the side slot wall 27, the lateral positioning reliability of the main body 20 on the base 10 can be enhanced, and the steadiness of the main body 20 on the base 10 can be enhanced by the elasticity of the ring unit 74. On the other hand, the requirement for the relatively fitted dimensional tolerance in side direction of the support block 71 and the slot 25 can be lowered, favorable for lowering the requirement for the accuracy of the support block 71 and the slot 25, so that the difficulty level of molding of the support block 71 and the slot 25 is reduced.

Furthermore, an embedding groove 75 is made in the side of the support blocks 71 facing the side slot wall 27 respectively, the ring unit 74 is embedded in the embedding groove 75, so as to position the ring unit 74.

Figure 11:
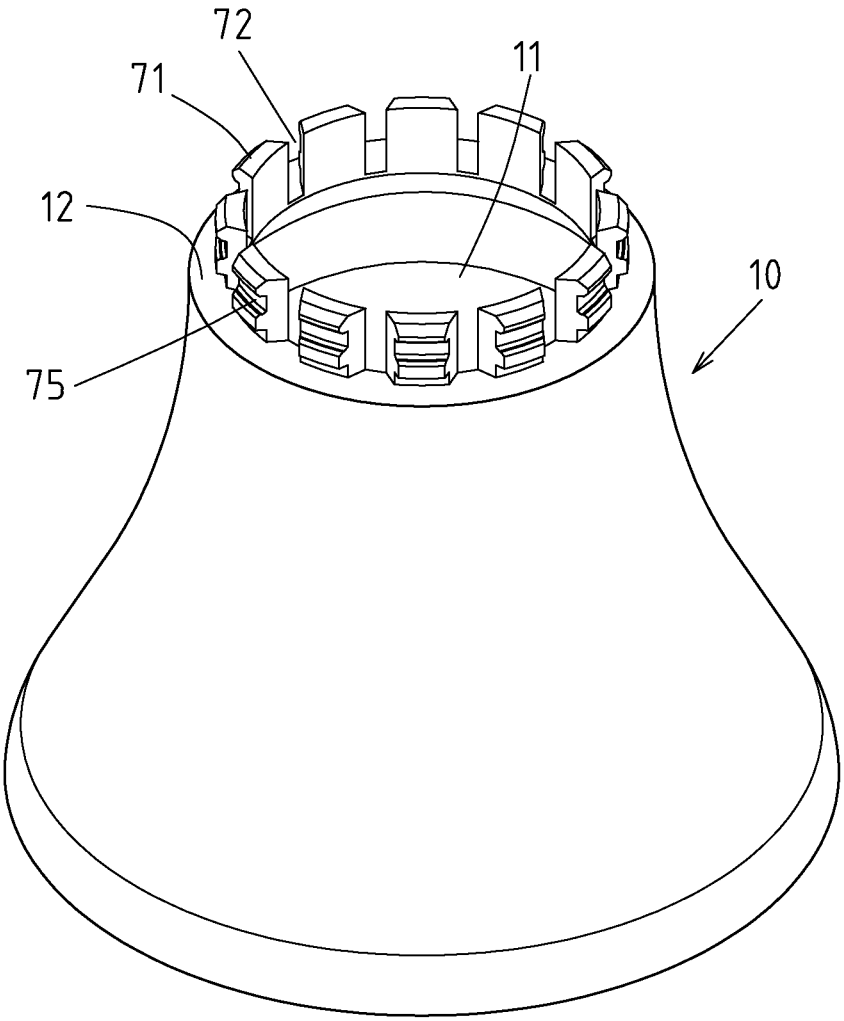
FIG. 11 is the stereogram of base of Embodiment 4 of the present invention.

The quantity and specific shape of the support blocks 71 can be changed as required, so as to form the Embodiment 4 shown in FIG. 11.

Figure 12:
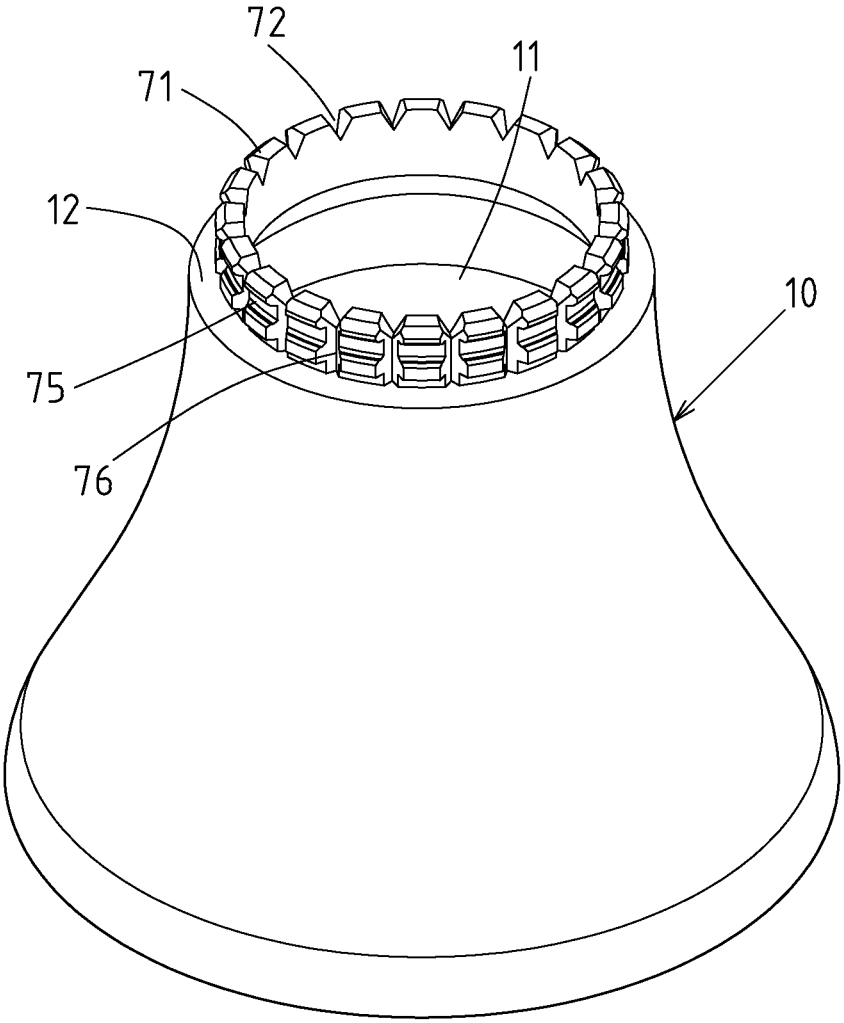
FIG. 12 is the stereogram of base of Embodiment 5 of the present invention.
Figure 13:
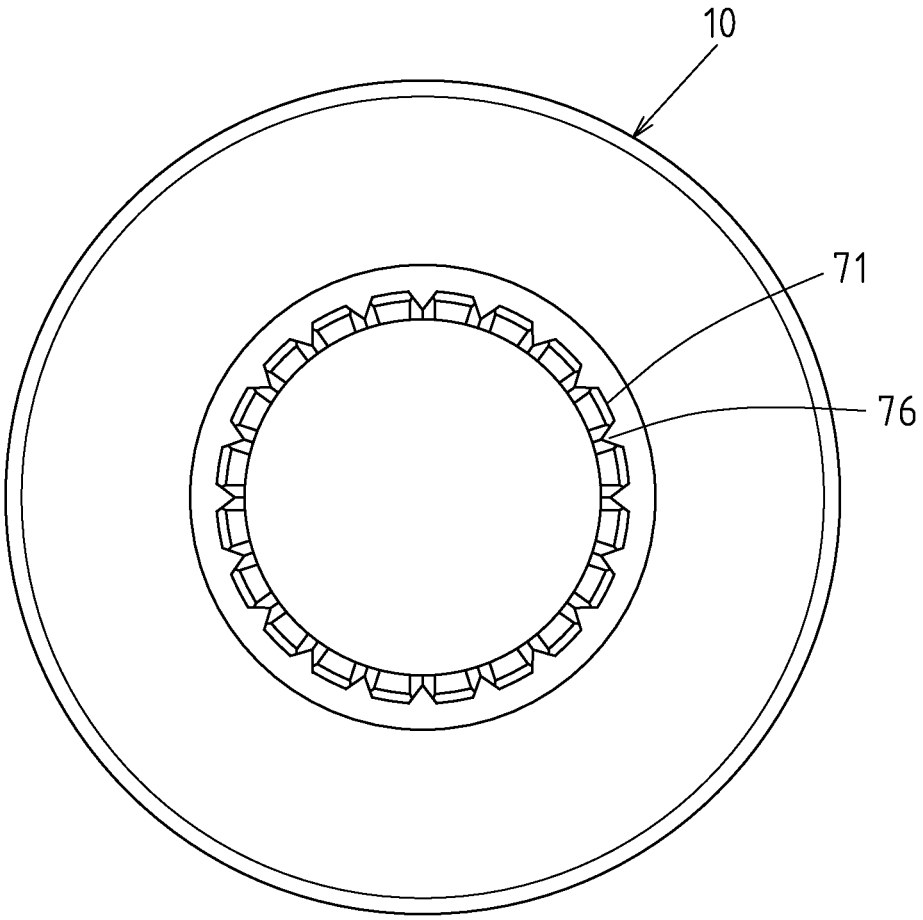
FIG. 13 is the top view of base of Embodiment 5 of the present invention.

As shown in FIGS. 12 and 13, the major difference between Embodiment 5 and Embodiment 1 is that a support block 71 is arranged on the top of the base 10, the support block 71 is annular, several connecting passages 72 are formed at one end of the support block 71 facing the abutting surface 26. The connecting passages 72 communicate with the chamber 11 and the gap 73 respectively.

Several air passages 76 are formed on the side of the support block 71 facing the side slot wall 27. Both ends of the air passages 76 extend to the top edge and bottom edge of the support block 71 respectively, and the air passages 76 communicate with the connecting passages 72 and the gap 73 respectively.

Figure 14:
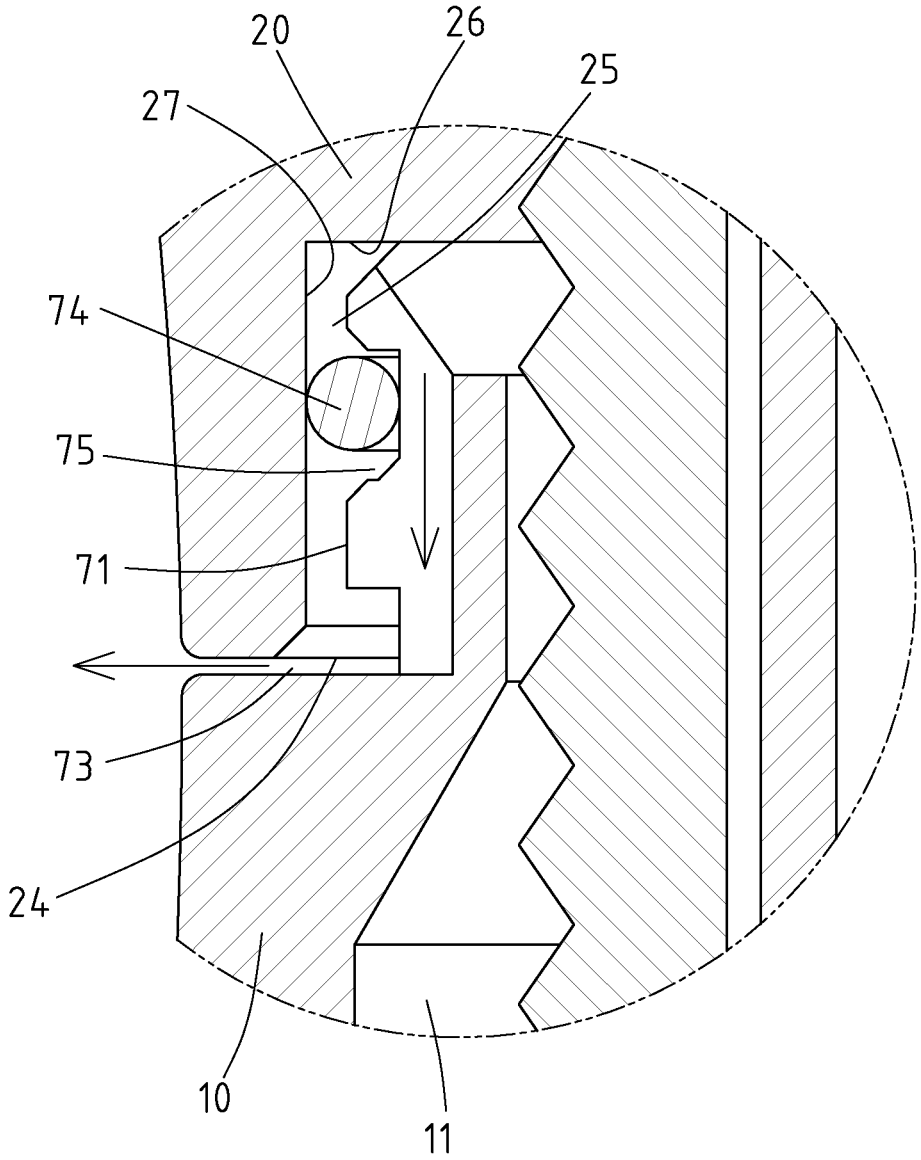
FIG. 14 is the sectional view of partial enlargement of Embodiment 5 of the present invention, displaying the abutting part of base and main body.

As shown in FIG. 14, Embodiment 5 can be provided with the ring unit 74 like Embodiment 3 as required. When the support block 71 is provided with the ring unit 74, the air passage 76 faces the annular inner side of the chamber 11 through the ring unit 74, the air can leave the chamber 11 through the connecting passage 72, the air passage 76 and the gap 73 and flow to the base 10 and the outside of the main body 20, and the outside air can flow into the chamber 11 through the gap 73, the air passage 76 and the connecting passage 72.

Figure 15:
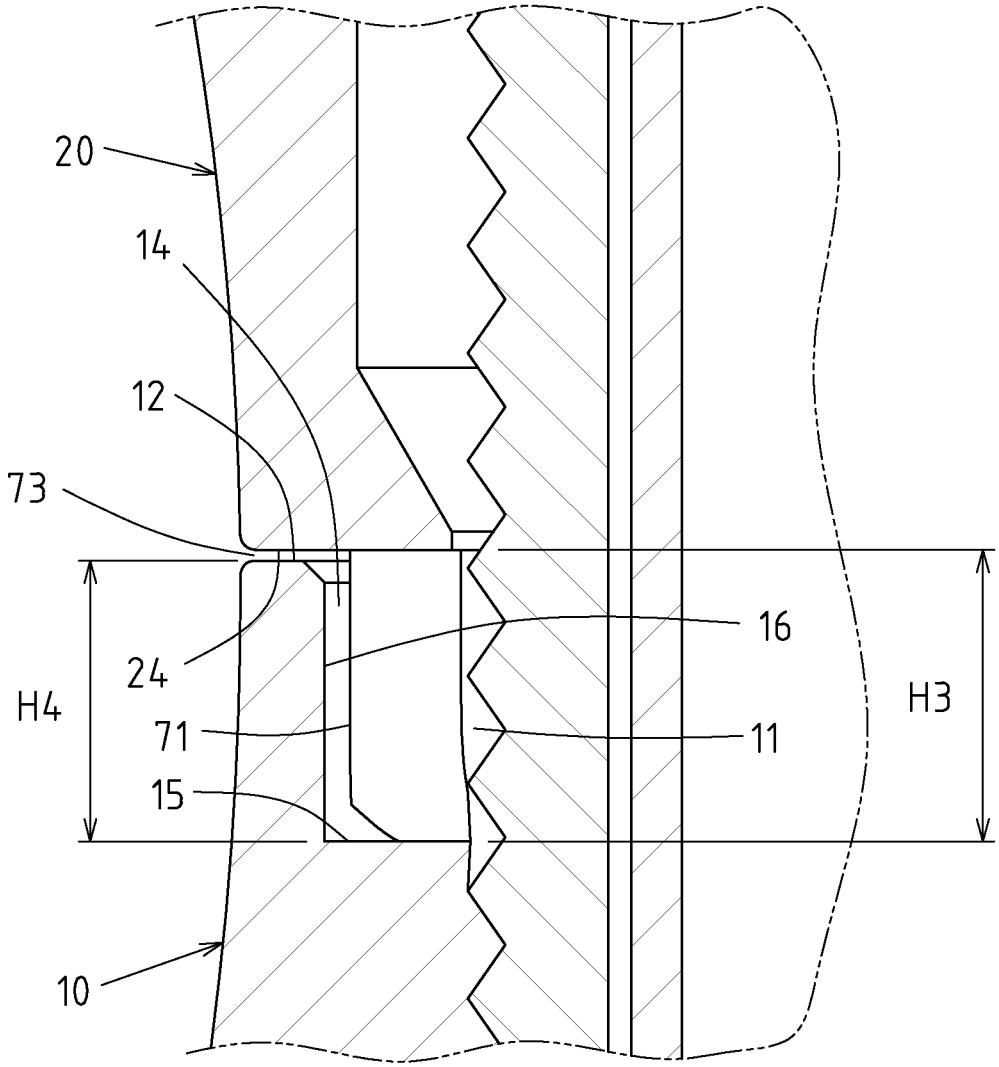
FIG. 15 is the sectional view of partial enlargement of Embodiment 6 of the present invention, displaying the abutting part of base and main body.

As shown in FIG. 15, the major difference between Embodiment 6 and Embodiment 1 is that the support block 71 is arranged at the bottom of the main body 20, the second surface 12 is formed on the top of the base 10, a slot 14 is formed in the base 10, the slot 14 extends downwards from the second surface 12 into the base 10, and the slot 14 communicates with the chamber 11. An abutting surface 15 is formed at one end of the slot 14 far from the second surface 12 of the base 10. The support block 71 enters the slot 14 and props the abutting surface 15. A side slot wall 16 is formed around the slot 14 of the base 10. The support block 71 is laterally opposite to the side slot wall 16. The distance in height between the top and bottom of the support block 71 is defined as the third height H3. The distance in height between the second surface 12 and the abutting surface 15 is defined as the fourth height H4. The third height H3 is larger than the fourth height H4, so that the gap 73 is formed between the second surface 12 and the bottom of the main body 20.

The difference between the third height H3 and the fourth height H4 is 0.05 mm-2 mm, in this case, the difference between the third height H3 and the fourth height H4 is 0.2 mm.

The Embodiment 6 can be changed to another form where the main body 20 is provided with a support block 71, and the support block 71 is annular, and the connecting passage (not shown in the figure) and air passage (not shown in the figure) are formed fitting the annular support block 71. The aforementioned annular support block 71, the connecting passage and the air passage are based on the application of the support block 71, the connecting passage 72 and the air passage 76 disclosed in Embodiment 5, but this kind of application can easily occur to the persons of related domains based on Embodiment 5 and Embodiment 6.

We claim:

1. A faucet assembly comprising:

a base with a chamber formed therein, the chamber extending to a bottom of said base;

a main body disposed on a top edge of said base and having a valve chamber, said main body having a first channel and a second channel formed therein, the first channel communicating with the valve chamber and the chamber of said base, the second channel communicating with the valve chamber and with an exterior of said main body, the first channel having an inlet pipe communicating therewith, the second channel having an outlet communicating therewith and adapted such that water enters the valve chamber through the inlet pipe and flows outwardly through the outlet pipe;

a control valve disposed in the valve chamber and adapted to allow water to flow from the first channel to the second channel; and a support block positioned between said base and said main body such that a gap is formed between said base and said main body, the gap communicating with the chamber of said base through at least one connecting passage, the gap communicating with a space exterior of the faucet such that air enters or leaves the chamber of said base through the gap, wherein said support block is positioned on a top of said base, said main body having a first surface formed at a bottom thereof, said main body having a slot formed thereon, the slot extending upwardly from the first surface into said main body, the slot communicating with the chamber of said base, the slot having an abutting surface formed at one end thereof away from the first surface of said main body, the support block entering the slot and propping the abutting surface such that the support block supports said main body, the slot of said main body having a side slot wall formed therearound, the support block being laterally opposite to the side slot wall, wherein a first height is defined by a distance between a bottom and a top of said support block, a second height being defined by a distance between the first surface and the abutting surface, the first height being greater than the second height, the gap being formed between the first surface and the top end of said base.

2. The faucet of claim 1, wherein said support block is positioned at a bottom of said main body, said base having a second surface formed at a top end of said base, the slot extending downwardly from the second surface into said base such that the slot communicates with the chamber of said base, wherein an abutting surface is formed at one end of the slot away from the second surface of said base, said support block entering the slot and propping the abutting surface, wherein the side slot wall is formed around the slot of said base, said support block being laterally opposite the side slot wall, wherein a third height is defined by a distance between the top and the bottom of said support block, a fourth height being defined by a distance between the second surface and the abutting surface, the third height being greater than the fourth height, the gap being formed between the second surface and the bottom of the main body.

3. The faucet of claim 2, said support block comprising a plurality of support blocks arranged in spaced relation, the at least one connecting passage comprising a plurality of connecting passages formed respectively between the plurality of support blocks, the plurality of connecting passages respectively communicating with the chamber of said base and the gap.

4. The faucet of claim 3, wherein the plurality of support blocks are annularly arranged.

5. The faucet of claim 4, further comprising:

a ring unit bushing and support block, said ring unit being formed of an elastic material, said ring unit propping the side slot wall, wherein an embedding groove is formed in a side of said support block facing the side slot wall, said ring unit being embedded in the embedding groove.

6. The faucet of claim 1, said support block comprising a plurality of support blocks arranged in spaced relation, the at least one connecting passage comprising a plurality of connecting passages formed respectively between the plurality of support blocks, the plurality of connecting passages respectively communicating with the chamber of said base and the gap.

7. The faucet of claim 6, wherein the plurality of support blocks are annularly arranged.

8. The faucet of claim 7, further comprising:

a ring unit bushing and support block, said ring unit being formed of an elastic material, said ring unit propping the side slot wall, wherein an embedding groove is formed in a side of said support block facing the side slot wall, said ring unit being embedded in the embedding groove.

9. The faucet of claim 2, wherein a plurality of air passages are formed on a side of said support block that faces the side slot wall, the plurality of air passages respectively communicating with the plurality of connecting passages and the gap.

10. The faucet of claim 9, further comprising:

a ring unit bushing and support block, said ring unit being formed of an elastic material, said ring unit propping the side slot wall, wherein an embedding groove is formed in a side of said support block facing the side slot wall, said ring unit being embedded in the embedding groove.

11. The faucet of claim 10, wherein a plurality of air passages are formed on a side of said support block that faces the side slot wall, the plurality of air passages respectively communicating with the plurality of connecting passages and the gap.

12. The faucet of claim 1, wherein a difference in height between the first height and the second height is between 0.05 mm and 2 mm.

13. The faucet of claim 2, wherein a difference in height between the third height and the fourth height is between 0.05 mm and 2 mm.

14. A faucet assembly comprising:

a base with a chamber formed therein, the chamber extending to a bottom of said base;

a main body disposed on a top edge of said base and having a valve chamber, said main body having a first channel and a second channel formed therein, the first channel communicating with the valve chamber and the chamber of said base, the second channel communicating with the valve chamber and with an exterior of said main body, the first channel having an inlet pipe communicating therewith, the second channel having an outlet communicating therewith and adapted such that water enters the valve chamber through the inlet pipe and flows outwardly through the outlet pipe;

a control valve disposed in the valve chamber and adapted to allow water to flow from the first channel to the second channel; and a support block positioned between said base and said main body such that a gap is formed between said base and said main body, the gap communicating with the chamber of said base through at least one connecting passage, the gap communicating with a space exterior of the faucet such that air enters or leaves the chamber of said base through the gap, wherein said support block is cambered, the at least one connecting passage being formed between a pair of cambered ends of said support block.

15. The faucet of claim 14, further comprising:

a ring unit bushing and support block, said ring unit being formed of an elastic material, said ring unit propping the side slot wall, wherein an embedding groove is formed in a side of said support block facing the side slot wall, said ring unit being embedded in the embedding groove.

16. The faucet of claim 14, wherein said support block is annular, the at least one connecting passage comprising a plurality of connecting passages formed at one end of said support block respectively facing the abutting surface, wherein the plurality of connecting passages respectively communicate with the chamber of said base and the gap.

17. The faucet of claim 16, further comprising:

a ring unit bushing and support block, said ring unit being formed of an elastic material, said ring unit propping the side slot wall, wherein an embedding groove is formed in a side of said support block facing the side slot wall, said ring unit being embedded in the embedding groove.

18. The faucet of claim 17, wherein a plurality of air passages are formed on a side of said support block that faces the side slot wall, the plurality of air passages respectively communicating with the plurality of connecting passages and the gap.

* * * * *